US006342310B2

(12) United States Patent
Hashimoto et al.

(10) Patent No.: US 6,342,310 B2
(45) Date of Patent: Jan. 29, 2002

(54) HOT-DIP GALVANIZED STEEL SHEET

(75) Inventors: Ikurou Hashimoto; Kenji Saitou; Hiroyuki Takeda; Koichi Makii, all of Kobe; Shunichi Hashimoto; Takayuki Yamamoto, both of Kakogawa; Masahiro Nomura; Kouki Ikeda, both of Kobe; Masafumi Shimizu, Kakogawa, all of (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/770,290

(22) Filed: Jan. 29, 2001

(30) Foreign Application Priority Data

Jan. 31, 2000 (JP) ..... 2000-022772
Jan. 15, 2001 (JP) ..... 2001-006571

(51) Int. Cl.[7] ..... B32B 15/18
(52) U.S. Cl. ..... 428/659; 427/433; 428/939
(58) Field of Search ..... 428/659, 939; 427/433

(56) References Cited

U.S. PATENT DOCUMENTS 6,030,714 A * 2/2000 Fujibayashi et al. ..... 428/659

FOREIGN PATENT DOCUMENTS

JP 7-34210 2/1995

* cited by examiner

*Primary Examiner*—Robert R. Koehler
(74) *Attorney, Agent, or Firm*—Oblon, Spivak, McClelland, Maier & Neustadt, PC

(57) ABSTRACT

A hot-dip galvanized steel sheet composed of a basis steel sheet containing Si in an amount of 0.05–2.5 mass % and Mn in an amount of 0.2–3 mass % and a hot-dip galvanized zinc layer formed on the surface thereof, wherein said hot-dip galvanized zinc layer is formed in such a way that there is an Si—Mn enriched phase which is found, by observation under a scanning electron microscope or a transmission electron microscope, in the vicinity of the interface in a region no shorter than 50 $\mu$m in the cross section perpendicular to the interface between the basis steel sheet and the hot-dip galvanized zinc layer, said Si—Mn enriched phase containing more than twice as much Si and/or Mn as the basis steel sheet and extending over a length no more than 80% of the length of the interface observed. This hot-dip galvanized steel sheet is free of bare spots even in the case where the basis steel sheet contains Si and Mn in a comparatively large amount and hence is liable to suffering bare spots.

6 Claims, 7 Drawing Sheets

BEFORE ANNEALING

AFTER ANNEALING

BEFORE ANNEALING

AFTER ANNEALING

AFTER PLATING

BEFORE ANNEALING

AFTER ANNEALING

AFTER PLATING

DISTRIBUTION OF CONCENTRATION OF Mn IN THE VICINITY OF THE SURFACE (INTERFACE BETWEEN THE PLATED LAYER AND THE BASIS STEEL SHEET) IN SAMPLE NO. 15

DISTRIBUTION OF CONCENTRATION OF Si IN THE VICINITY OF THE SURFACE (INTERFACE BETWEEN THE PLATED LAYER AND THE BASIS STEEL SHEET) IN SAMPLE NO. 20

HOT-DIP GALVANIZED STEEL SHEET

BACKGROUND OF THE INVENTION

1. Field of the Invention

The present invention relates to a hot-dip galvanized steel sheet to be used as a corrosion preventive steel sheet for automobiles. More particularly, the present invention relates to a hot-dip galvanized steel sheet which has a good surface appearance free of bare spots even through its basis material contains Si and Mn which are said to adversely affect platability, said good surface appearance being produced by adequately controlling (in if terms of morphology) the Si—Mn concentrated phase occurring in the vicinity of the interface between the basis material and the zinc layer. Incidentally, the term "hot-dip galvanized steel sheet" used herein embraces not only ordinary ones carrying the zinc layer as it is formed by dipping in the plating bath but also so-called hot-dip galvannealed steel sheets which have undergone heat treatment for alloying after galvanizing (to form the zinc layer on the basis material).

2. Description of the Related Art

There is an increasing demand for improvement in fuel consumption rate as a part of the policy for global warming due to $CO_2$ discharge. To this end, a new target for improved fuel consumption has been set up and a new tax system has been introduced in favor of cars with improved fuel economy. One effective way of improving fuel consumption rate is by reduction of body weight. Achieving this object requires the raw material to have higher tensile strength than before. This is also the case with hot-dip galvanized sheet sheets. For hot-dip galvanized steel sheets to have both high tensile strength and good formability, the basis material (steel sheet) should be incorporated with such elements as C, Si, Mn, and Cr.

Unfortunately, such additional elements (particularly Si and Mn which are easily oxidizable elements) preferentially oxidize and concentrate on the surface of steel sheet during annealing in a reducing atmosphere, thereby greatly aggravating wettability and giving rise to bare spots detrimental to the external appearance. The reason for this is that hot-dip galvanizing is preceded immediately by annealing in a reducing atmosphere for reduction of Fe oxides on the surface (which is necessary for the steel sheet to exhibit good platability) and this annealing yields oxides of Si and Mn which are poor in compatibility with the galvanized zinc layer.

Consequently, it is essential that the formation of Si and Mn oxides should be minimized at the time of production of hot-dip galvanized high-tensile steel sheets. Among many other means to achieve this objective is an additional step preceding the ordinary annealing (for reduction) and hot-dip galvanizing, as disclosed in Japanese Patent Laid-open No. 34210/1995. This additional step consists of heating the steel sheet up to 400–650° C. so that Fe is oxidized in the preheating zone of the annealing furnace whose atmosphere has an oxygen concentration of 0.1–100%.

Hot-dip galvanizing in the above-mentioned way depends on Si content in steel sheets for its effect and hence it is not necessarily suitable for steel sheets with a high Si content. It gives a zinc layer which is complete (free of bare spots) immediately after hot-dipping but peels off due to insufficient adhesion in succeeding fabricating steps, as demonstrated in Examples given later. In other words, Si and Mn cannot be added sufficiently because of restrictions imposed by platability although they are essential to improving the formability of steel sheets. Therefore, incorporation with Si and Mn is not a practical solution to the problem.

Another way of avoiding bare spots is by depositing Fe or Ni on the surface of steel sheet by preliminary electroplating prior to annealing for reduction and hot-dip galvanizing. Electroplating unfavorably needs additional equipment and steps, leading to an increased production cost.

OBJECT AND SUMMARY OF THE INVENTION

The present invention was completed in view of the foregoing. It is an object of the present invention to provide a hot-dip galvanized steel sheet which has high tensile strength, good formability, and good surface appearance (free from bare spots) even though the basis steel sheet contains Si and Mn in a comparatively large amount and hence is prone to suffering bare spots.

The first aspect of the present invention resides in a hot-dip galvanized steel sheet composed of a basis steel sheet containing Si in an amount of 0.05–2.5 mass % and Mn in an amount of 0.2–3 mass % and a hot-dip galvanized zinc layer formed on the surface thereof, wherein said hot-dip galvanized zinc layer is formed in such a way that there is an Si—Mn enriched phase which is found, by observation under a scanning electron microscope or a transmission electron microscope, in the vicinity of the interface in a region no shorter than 50 $\mu$m in the cross section perpendicular to the interface between the basis steel sheet and the hot-dip galvanized zinc layer, said Si—Mn enriched phase containing more than twice as much Si and/or Mn as the basis steel sheet and extending over a length no more than 80% of the length of the interface observed.

The second aspect of the present invention resides in the hot-dip galvanized steel sheet as defined in the first aspect of the present invention, wherein the Si—Mn enriched phase containing no less than twice as much Si and/or Mn as the basis steel sheet is found, by observation under a transmission electron microscope, in the boundary between grains or the inside of grains of the basis steel sheet within 1 $\mu$m in the depthwise direction from the interface.

The third aspect of the present invention resides in the hot-dip galvanized steel sheet as defined in the second aspect of the present invention, wherein the Si—Mn enriched phase existing in the boundary between grains or the inside of grains of the basis steel sheet has a size no smaller than 5 nm×5 nm.

The fourth aspect of the present invention resides in the hot-dip galvanized steel sheet as defined in the second aspect of the present invention, wherein the Si—Mn enriched phase existing in the grain boundary of the basis steel sheet has a length no less than 10% of the overall length of the grain boundary of the basis steel sheet in the field of vision of observation.

The fifth aspect of the present invention resides in the hot-dip galvanized steel sheet as defined in the first aspect of the present invention, which contains a compound no smaller than 5 nm in outside diameter, which is composed of atoms having an atomic number smaller than the average atomic number of atoms constituting the steel, in the boundary between grains or the inside of grains of the basis steel sheet within a range of 1 $\mu$m in the depthwise direction from the interface, said compound being observed under a transmission electron microscope.

The sixth aspect of the present invention resides in a hot-dip galvanized steel sheet composed of a basis steel sheet containing Si in an amount of 0.05–2.5 mass % and Mn in an amount of 0.2–3 mass % and a hot-dip galvanized zinc layer formed on the surface thereof, wherein the basis steel sheet in the vicinity of the interface between the basis steel sheet and the hot-dip galvanized zinc layer contains Si or Mn in the form of solid solution such that its amount is less than 0.7 times the amount of Si or Mn in the composition of the basis steel sheet.

DESCRIPTION OF THE PREFERRED EMBODIMENTS

Figure 1A:
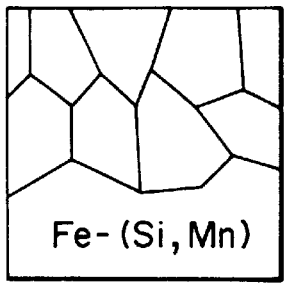
FIG. 1 is a schematic sectional view showing the structure in the vicinity of the interface of the conventional hot-dip galvanized steel sheet.
Figure 1B:
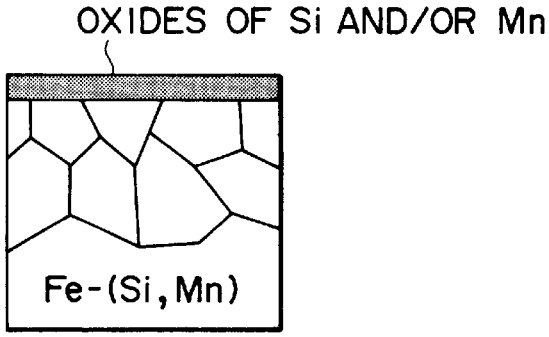
Figure 1C:
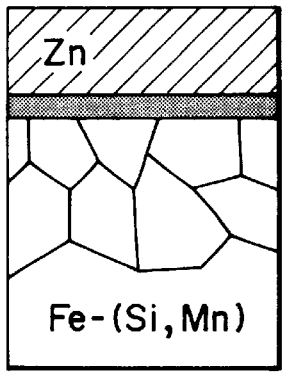

The hot-dip galvanized steel sheet according to the present invention is characterized by its unique sectional structure. FIG. 1 is a schematic sectional view showing the structure in the vicinity of the interface of the conventional hop-dip galvanized steel sheet. FIGS. 1(*a*), 1(*b*) and 1(*c*) show the structure before annealing, after annealing, and after hot-dip galvanizing, respectively.

The production of hot-dip galvanized steel sheet usually includes the step of annealing for reduction in an atmosphere which does not oxidize Fe but oxidizes Si and Mn (which are easily oxidizable elements). Annealing causes these elements in the steel to be selectively oxidized, with the resulting oxides diffusing to the surface. As the result, the surface of the steel sheet is covered by an enriched layer of oxides (of one element or two or more elements combined together), as shown in FIG. 1(*b*). Being poor in wettability by the plated layer, the enriched layer causes bare spots to occur in the plating formed thereon.

Figure 2A:
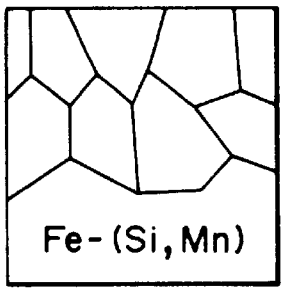
FIG. 2 is a schematic sectional view showing the structure in the vicinity of the interface of the hot-dip galvanized steel sheet according to the present invention.
Figure 2B:
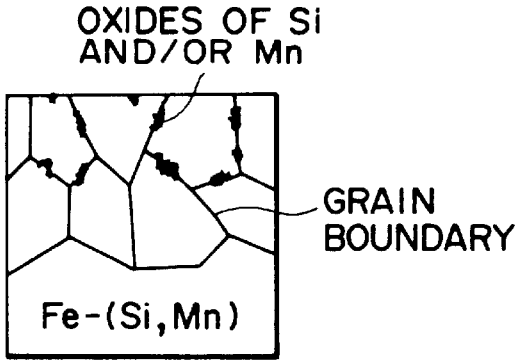
Figure 2C:
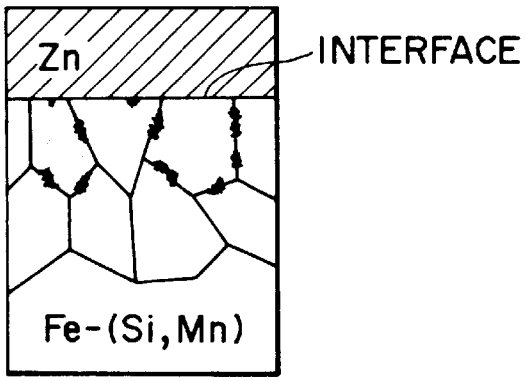

With their attention paid to how platability depends on the interface structure of the basis steel sheet, the present inventors conceived that if a steel sheet containing Si and Mn has Si oxide and/or Mn oxide dispersed in the vicinity of grain boundaries after annealing (as schematically shown in FIG. 2), these oxides will not diffuse to and accumulate on the surface to hinder plating. The oxide-free surface of the basis steel sheet should have good wettability with molten zinc.

In order to elucidate the distribution of oxides in steel sheet, the present inventors produced several samples of hot-dip galvanized steel sheets under various conditions from a basis steel sheet containing Si and Mn. The cross section of each sample, with or without bare spots, was observed under a scanning electron microscope (SEM) and a transmission electron microscope (TEM). The elemental analysis of each phase was also carried out. It was found that platability depends on the sectional structure in the vicinity of the interface between the basis steel sheet and the plated layer, as explained in the following.

According to the present inventors' finding, good platability is achieved only when the layer of Si—Mn oxides (which is detrimental to platability) on the steel surface has as small an area as possible before plating. [The term "Si—Mn oxides" implies oxides of individual elements or two elements combined together. It may be replaced by the term "enriched phase" hereinafter.] To this end, the hot-dip galvanized zinc layer should be formed in such a way that there is an Si—Mn enriched phase which is found, by observation under a scanning electron microscope or a transmission electron microscope, in the vicinity of the interface in a region no shorter than 50 $\mu$m in the cross section perpendicular to the interface between the basis steel sheet and the hot-dip galvanized zinc layer, said Si—Mn enriched phase containing more than twice as much Si and/or Mn as the basis steel sheet and extending over a length no more than 80% of the length of the interface observed. Under these conditions, there exists metallic Fe (which has good wettability) around the Si—Mn enriched phase, and hence there is not the possibility of bare spots occurring.

It is specified above that the content of Si and/or Mn in the Si—Mn enriched phase should be more than twice that of the basis steel sheet. The reason for this is as follows. The enriched layer is composed of oxides, $SiO_2$ and $Mn_2SiO_4$, the former containing 46% Si and the latter containing 54% Mn and 14% Si (calculated from their stoichio-metric composition). However, the actual composition may deviate from these values and contain foreign elements. For example, the analytical value of Si and Mn actually measured by an energy-dispersive X-ray spectrometer (EDS), with a beam diameter of 10 nm and a thickness of 100 nm, is apparently smaller than the stoichiometric value because of influence by phases present in the vicinity. Nevertheless, the present inventors' researches revealed that the presence of Si oxides and Mn oxides detrimental to platability is detected by EDS if the concentration of Si and Mn in the oxides is no less than twice that in the basis steel sheet.

The interface effectively takes on the state mentioned above if the Si—Mn enriched layer is formed in the basis steel sheet so that the amount of Si and Mn due to enrichment is reduced on the plating surface (or the interface between the plated layer and the basis steel sheet). It is desirable that the Si—Mn enriched phase in the grain boundary in the basis steel sheet within 1 $\mu$m in the depthwise direction from the interface (in the TEM electron micrograph) contains no less than twice as much Si or Mn than the basis steel sheet.

The above-mentioned effect of improving platability becomes more significant as the amount of enriched Si—Mn increases. For further improvement in platability, it is desirable that there exist Si—Mn enriched phases no smaller than 5 nm×5 nm which are recognized by image analysis. It is also desirable that the ratio of the Si—Mn enriched phase to the grain boundary is such that the length along the grain boundary of the Si—Mn enriched phase is no less than 10% of the overall length of the grain boundary in the basis steel sheet in the field of vision of observation. The reason for this is that enrichment in the surface is prevented more effectively as the amount of Si or Mn in the grain boundary increases or the length of each enriched phase increases in the grain boundary.

The desirable morphology mentioned above is confirmed by the TEM electron micrograph. TEM permits observation of those fine Si—Mn enriched phases undetectable by SEM which exist in the grain boundary of the basis steel sheet and prevent Si—Mn enrichment in the surface.

The presence of the Si—Mn enriched layer is confirmed by means of electron micrographs taken by SEM or TEM equipped with EDS. Without EDS, the same result will be obtained by observation with a dark field scanning transmission electron microscope (D-STEM) which gives the Z-contrast or by observation with a SEM which gives back-scattered electron patterns. In electron micrographs obtained by the Z-contrast method, the Si—Mn enriched layer is recognized as dark images because it is composed of atoms having a smaller average atomic number compared with the basis steel sheet.

No elucidation has been made on the diffusion and oxidation of Mn in steel. Presumably, Mn coexisting with Si forms complex oxides (for example; $Mn_2SiO_4$) which concentrated in the surface, thereby hindering platability, whereas Si forms oxides in the grain boundary in the basis steel sheet and hence the amount of Si forming solid solution in the steel decreases, thereby suppressing the formation of complex oxides or suppressing the enrichment of Mn in the surface.

The sectional structure shown in FIG. 2 may be realized if proper conditions are set up for oxidation preceding reduction annealing and reduction annealing. Oxidation and reduction should be carried out under adequate conditions according to the amount of Si and Mn in the steel. For example, oxidation should be carried out at 680° C. or above for 15 seconds or more in an atmosphere containing no less than 10% oxygen, and ensuing reduction should be carried out at 750° C. or above for 30 seconds or more in an atmosphere containing no less than 5% hydrogen and having a dew point no higher than −10° C. For a steel sheet containing 1.5% Mn and 0.3% Si, oxidation should be carried out at 700° C. for 40 seconds in an atmosphere containing 20% oxygen and ensuing reduction should be carried out at 800° C. for 60 seconds in an atmosphere containing 10% hydrogen and having a dew point of −40° C.

The foregoing is concerned with platability which is affected by the sectional structure in the vicinity of the interface between the zinc layer and the basis steel sheet, said platability relating to a hot-dip galvanized steel sheet which has the zinc layer simply formed by dipping in the plating bath. This hot-dip galvanized steel sheet may be converted into a hot-dip galvannealed steel sheet by heat treatment (or alloying treatment) that follows galvanizing. It would be possible to obtain a hot-dip galvannealed steel sheet which is free of bare spots and has high tensile strength, good formability, and good surface properties if the process prior to alloying treatment is carried out so as to avoid bare spots by setting up adequate conditions for oxidation preceding reduction annealing and reduction annealing. Unfortunately, alloying treatment alters the sectional structure in the vicinity of the interface between the zinc layer and the basis steel sheet and hence it is difficult to confirm the following state (mentioned above) after alloying treatment.

1) The state in which the Si—Mn enriched phase containing no less than twice as much Si or Mn as the basis steel sheet extends over a length no more than 80% of the length of the interface observed.
2) The state in which the Si—Mn enriched phase containing no less than twice as much Si or Mn as the basis steel sheet is present in the boundary between grains within 1 $\mu$m in the depthwise direction from the interface. Nevertheless, the present inventors' investigation revealed that the hot-dip galvanized steel sheet remains free of bare spots and retains high tensile strength, good formability, and good surface properties even after alloying treatment provided that the amount of Si or Mn forming solid solution in the basis steel sheet in the vicinity of the interface between the zinc layer and the basis steel sheet is less than 0.7 times the amount of Si or Mn in the basis steel sheet. Needless to say, the interface between the zinc layer and the basis steel sheet as used above means that after alloying treatment. Incidentally, it is possible to confirm how Si and Mn form solid solution in the interface after alloying treatment by determining with TEM equipped with EDS the composition in the region free of precipitations which is 0.1 $\mu$m deep (toward the basis steel sheet) from the interface between the plating layer (Zn layer, Zn—Fe alloy layer, or Al—Fe alloy layer) and the basis steel sheet.

The content of Si and Mn as the fundamental components of the basis steel sheet used in the present invention has no lower limit from the standpoint of platability because Si and Mn are harmful to plating; however, the steel sheet should contain at least 0.05% of Si and at least 0.2% of Mn so that it has high strength and good formability. The upper limit of Si and Mn is 2.5% and 3%, respectively, because these elements in an excess amount adversely affect formability.

Incidentally, the present invention produces its better effect in the case of a steel sheet containing no less than 0.7% of Si and Mn all together. Such a steel sheet yields a hot-dip galvanized steel sheet having a good surface state free of bare spots, while retaining high tensile strength and good formability suggested by the product of tensile strength (TS) and elongation (El) which is no less than 15400 (MPa %) as illustrated in Examples given later.

Moreover, the present invention produces its maximum effect in the case of a transformation induced plasticity steel sheet containing no less than 0.03% of C, no less than 0.7% of Si, no less than 0.5% of Mn and no less than 5% of the austenite fraction. Such a steel sheet yields a hot-dip galvanized steel sheet having a good surface state free of bare spots, while retaining high tensile strength and good formability suggested by the product of TS and El which is no less than 20000 (Mpa·%) as illustrated in Example 3 given later.

In the meantime, the steel sheet to which the present invention is directed contains Si, Mn, C, Al, P, and S as basic components, and it also contains optional elements such as Ti, Nb, Mo, V, Zr, N, and B. Their content is not specifically restricted so long as it is within the ordinary range. Moreover, the steel sheet may contain trace elements having no effect on its characteristic properties. The steel sheet is not specifically restricted in thickness. The one having a thickness of 0.6–3.0 mm will produce desirable results as demonstrated in Examples given later.

EXAMPLES

To further illustrate the invention, and not by way of limitation, the following examples are given.

Example 1

Samples of various hot-dip galvanized steel sheets were prepared from steel sheets varying in composition (in terms of Si and Mn) and thickness as shown in Table 1. The process of hot-dip galvanizing consists of oxidation for 40 seconds under the conditions (oxygen concentration and temperature) shown in Table 1, reduction treatment at 800° C. for 60 seconds under the conditions (hydrogen concentration and dew point) shown in Table 1, and dipping in a zinc plating bath, followed by cooling to room temperature.

The thus obtained samples were visually rated for platability. Those samples free of bare spots are indicated by the mark ○, and those samples with bare spots are indicated by the mark ×. They were also rated for mechanical properties in terms of the product of tensile strength (TS) and elongation (El) of their specimens. Those having a value of TS×El no less than 15400 were regarded as satisfactory. Moreover, for the Si—Mn enriched phase in the grain boundary and in the interface, the samples were examined by means of electron micrographs taken by a transmission electron microscope and a scanning electron microscope giving backscattered electron images.

The results are shown, together with the oxidizing and reducing conditions, in Table 1. It is noted that those samples meeting the requirements of the present invention exhibit good platability without deterioration in mechanical properties.

elements having an atomic number smaller than the average atomic number of constituent elements in the basis steel sheet. The backscattered electron images were examined for the ratio of the oxide phase in the interface over a length of 50 μm. The ratio was no larger than 80% in the case of sample No. 4, which had good platability. By contrast, the ratio was larger than 80% in the case of sample No. 9, which was poor in platability.

Figure 5:
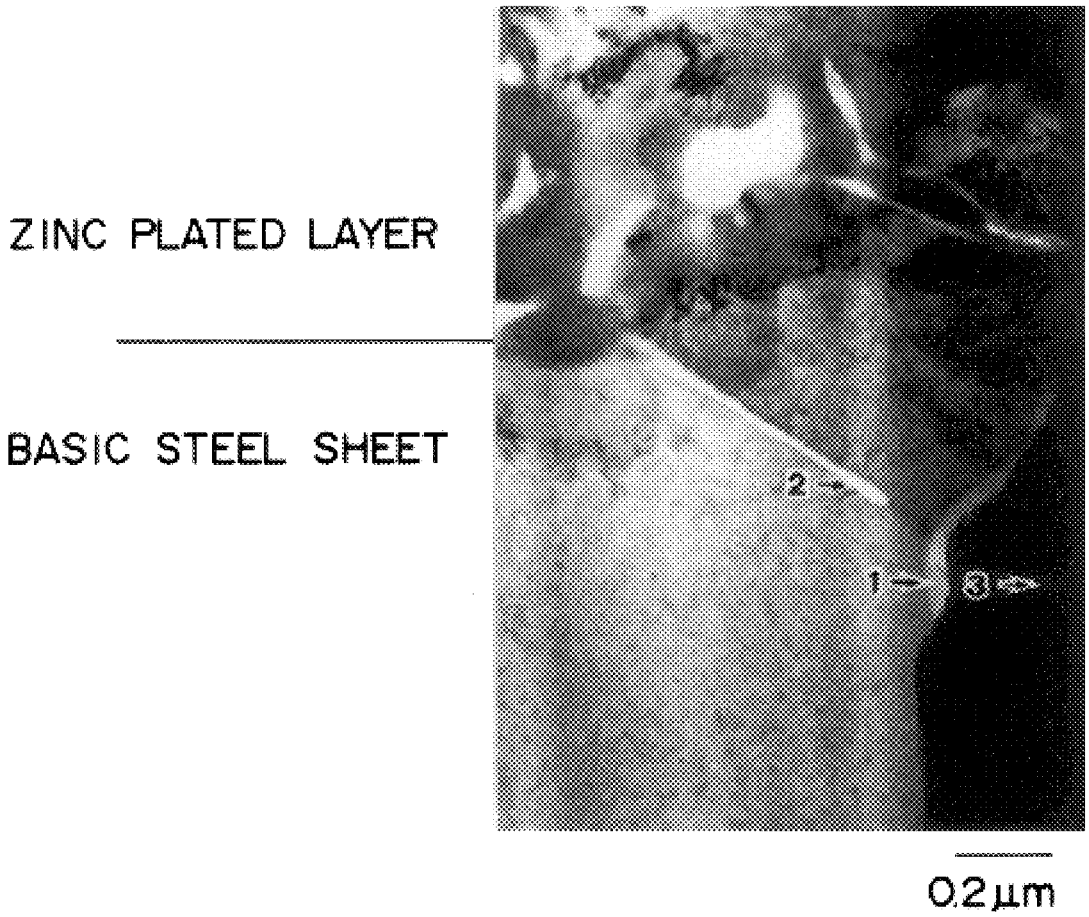
FIG. 5 is an electron micrograph of the section of sample No. 4 taken by a transmission electron microscope after hot-dip galvanizing in Example.

Sample No. 4 (in Example) was examined for its cross section after plating by means of a transmission electron microscope. It gave an electron micrograph as shown in FIG. 5 (which substitutes for a drawing). The sample for observation was about 0.1 μm thick which was prepared by means of a focused ion beam (FIB) from a cross section, measuring 5 μm×5 μm, including the interface between the plated layer and the basis steel sheet. Elemental analysis was performed on the sample at three positions (1, 2, and 3) indicated in FIG. 5. (Elemental analysis employed a field emission transmission electron microscope equipped with an energy-dispersive X-ray spectrometer [HF2000 from Hitachi Ltd.], with an acceleration voltage of 200 kV and an electron beam diameter of about 20 nm.) The results are shown in Table 2. It is apparent from this table that the Si—Mn enriched phase is formed along the grain boundary in the basis steel sheet. This tendency was also noticed in samples Nos. 1 to 3. Presumably, this phase structure is responsible for the good platability.

TABLE 1

| | Composition of basis steel sheet (mass %) | | | Sheet | Conditions of oxidation | | Conditions of reduction | | Si enriched | Si—Mn enriched | | | | | |
|---|---|---|---|---|---|---|---|---|---|---|---|---|---|---|---|
| No. | C | Si | Mn | thickness (mm) | $O_2$ (%) | Temp (° C.) | $H_2$ (%) | Dew point (° C.) | phase in grain boundary (%) | phase in interface (%) | Platability | TS (MPa) | El (%) | TS × El | Remarks |
| 1 | 0.05 | 0.3 | 1.5 | 1.2 | 20 | 700 | 10 | −40 | 5 | 30 | ○ | 482 | 35.5 | 17111 | Example |
| 2 | 0.05 | 0.5 | 1.5 | 1.2 | 20 | 660 | 10 | −40 | 7 | 50 | ○ | 491 | 37.1 | 18216 | Example |
| 3 | 0.05 | 0.5 | 1.5 | 1.2 | 20 | 680 | 10 | −40 | 9 | 35 | ○ | 489 | 37.3 | 18435 | Example |
| 4 | 0.05 | 0.5 | 1.5 | 1.2 | 20 | 700 | 10 | −40 | 15 | 25 | ○ | 492 | 37.1 | 18253 | Example |
| 5 | 0.05 | 0.3 | 1.5 | 0.8 | 20 | 700 | 10 | −40 | 5 | 30 | ○ | 480 | 34.1 | 16368 | Example |
| 6 | 0.05 | 0.3 | 1.5 | 1.0 | 20 | 700 | 10 | −40 | 5 | 30 | ○ | 478 | 35.3 | 16873 | Example |
| 7 | 0.05 | 0.3 | 1.5 | 1.6 | 20 | 700 | 10 | −40 | 5 | 30 | ○ | 480 | 36.6 | 17568 | Example |
| 8 | 0.05 | 0.3 | 1.5 | 2.0 | 20 | 700 | 10 | −40 | 5 | 30 | ○ | 477 | 38.5 | 18364 | Example |
| 9 | 0.05 | 0.5 | 1.5 | 1.2 | No oxidation | | 10 | −40 | 0 | 95 | X | 486 | 37.2 | 18079 | Comp. Example |
| 10 | 0.05 | 0.5 | 1.5 | 1.2 | 20 | 200 | 10 | −40 | 0 | 95 | X | 486 | 37.4 | 18176 | Comp. Example |
| 11 | 0.05 | 0.02 | 0.1 | 1.2 | No oxidation | | 10 | −40 | 0 | 0 | ○ | 413 | 34.8 | 14372 | Comp. Example |
| 12 | 0.05 | 0.02 | 1.5 | 1.2 | No oxidation | | 10 | −40 | 0 | 40 | ○ | 462 | 35.3 | 14900 | Comp. Example |
| 13 | 0.05 | 0.02 | 3.5 | 1.2 | No oxidation | | 10 | −40 | 0 | 75 | ○ | 503 | 30.5 | 15341 | Comp. Example |
| 14 | 0.05 | 3.0 | 0.1 | 1.2 | No oxidation | | 10 | −40 | 0 | 95 | X | 742 | 20.6 | 15285 | Comp. Example |

Figure 3:
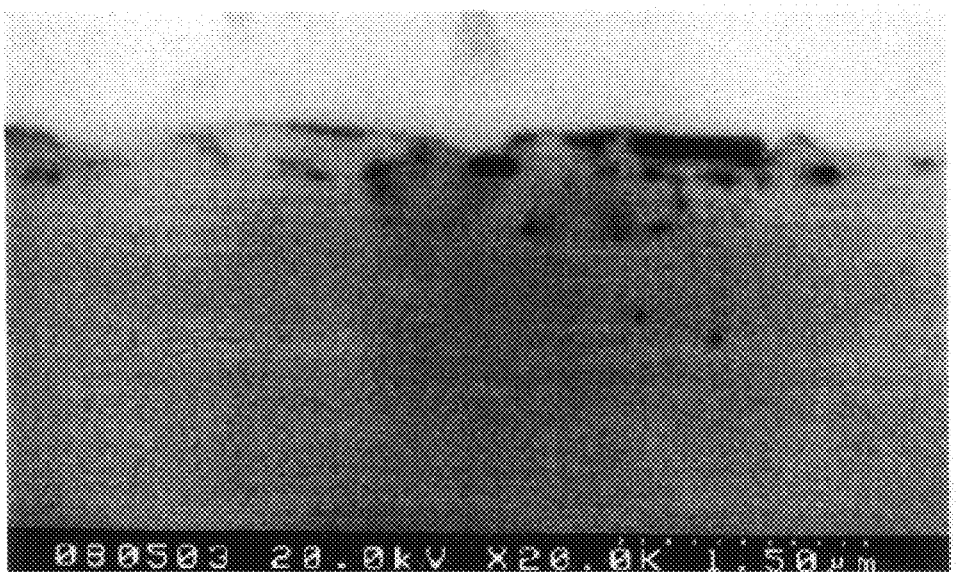
FIG. 3 is an electron micrograph of the section of sample No. 4 taken by a field emission scanning electron microscope after hot-dip galvanizing in Example.

Sample No. 4 (in Example), which had good platability, was examined for its cross section after plating by means of a field emission scanning electron microscope. It gave a backscattered electron image as shown in FIG. 3 (which substitutes for a drawing).

Figure 4:
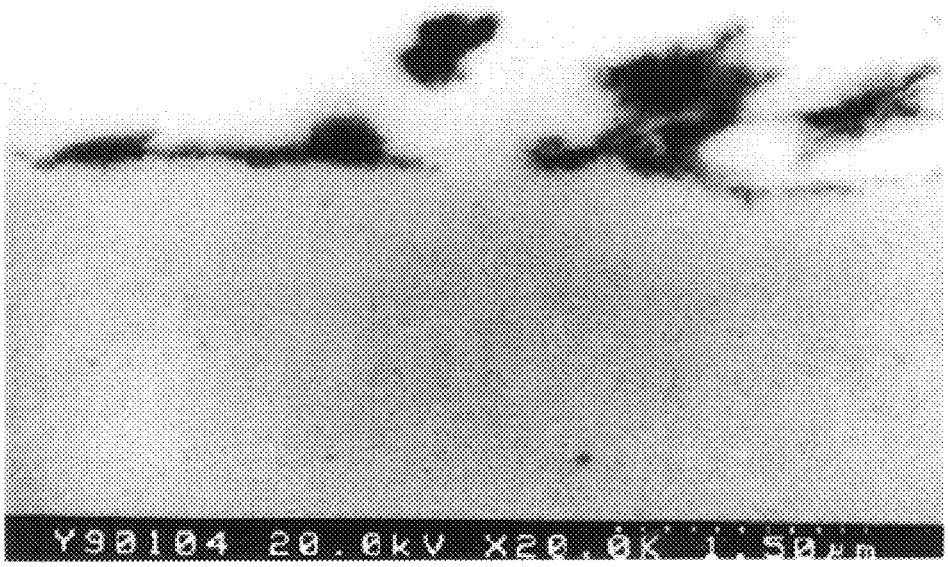
FIG. 4 is an electron micrograph of the section of sample No. 9 taken by a field emission scanning electron microscope after hot-dip galvanizing in Comparative Example.

Sample No. 9 (in Comparative Example), which was poor in platability, was examined for its cross section after plating by means of a field emission scanning electron microscope. It gave a backscattered electron image as shown in FIG. 4 (which substitutes for a drawing).

Both electron micrographs show a dark phase in the interface. This dark phase signifies the phase of oxides of

TABLE 2

| Position for analysis | Composition (mass %) Fe | Si | O | Mn | Zn, Al, etc. |
|---|---|---|---|---|---|
| 1 | 66.1 | 4.9 | 20.8 | 1.4 | 6.7 |
| 2 | 73.32 | 2.7 | 15.7 | 1.4 | 7.1 |
| 3 | 84.5 | 0.3 | 6.5 | 1.2 | 7.5 |

Figure 6:
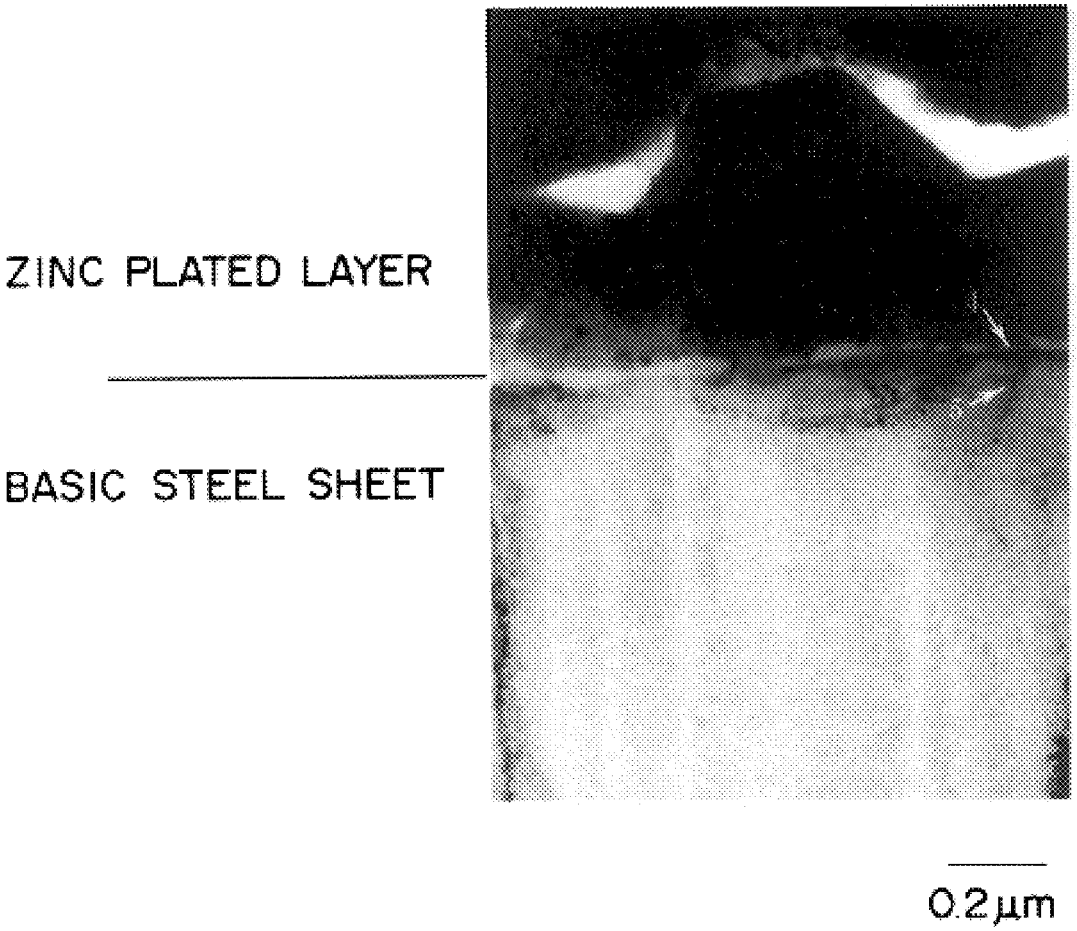
FIG. 6 is an electron micrograph of the section of sample No. 9 taken by a transmission electron microscope after hot-dip galvanizing in Comparative Example.

Sample No. 9 (in Comparative Example) was examined for its cross section after plating by means of a transmission electron microscope. It gave an electron micrograph as shown in FIG. 6. Elemental analysis was performed on the sample at two positions (4 and 5) indicated in FIG. 6. The results are shown in Table 3. It is noted that the Si—Mn enriched phase does not exist in the basis steel sheet but exists continuously along the interface between the plated layer and the basis steel sheet.

The same sectional structure as above was also noticed in sample No. 10. By contrast, samples Nos. 11 to 13 had good platability but had poor formability and low strength (or a small product of tensile strength and elongation). This good platability is due to the fact that the basis steel sheet contains only a small amount of Si and/or Mn and the Si—Mn enriched phase does not exist in the interface face between the plated layer and the basis steel sheet. Samples Nos. 13 and 14 were poor in formability due to an excess content of Si or Mn.

TABLE 2

| Position for analysis | Composition (mass %) Fe | Si | O | Mn | Zn, Al, etc. |
|---|---|---|---|---|---|
| 4 | 21.4 | 5.6 | 43.6 | 14.4 | 15.0 |
| 5 | 73.3 | 0.4 | 11.4 | 0.9 | 14.1 |

Example 2

Figure 7:
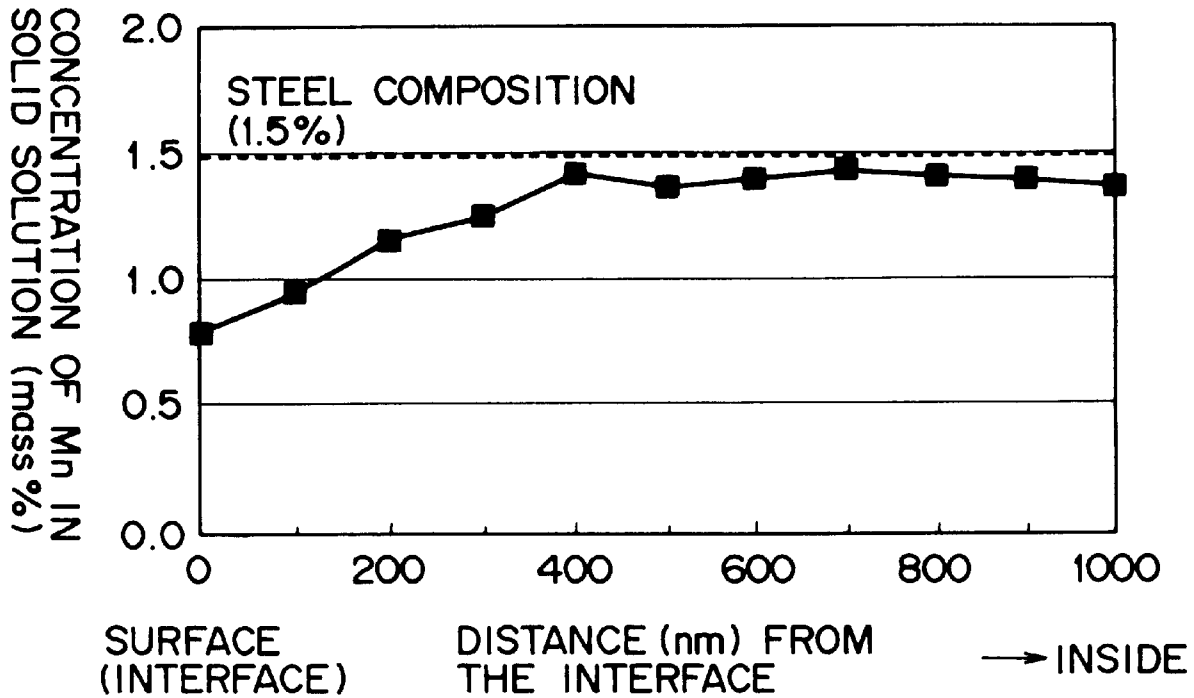
FIG. 7 is a diagram showing how the concentration of Mn in the form of solid solution in the basis steel sheet is distributed in the vicinity of the interface between the basis steel sheet and the hot-dip galvanized zinc layer in Sample No. 15.

Samples of hot-dip galvanized steel sheets were prepared from several kinds of high-strength high-ductility IF steel (interstitial-free steel) incorporated with Mn and Si, by oxidation treatment in air (containing 20% oxygen) under the conditions (for temperature and period of time) shown in Table 4 and ensuing reduction treatment at 860° C. for 2 minutes in a hydrogen-nitrogen atmosphere containing 10% hydrogen and having a dew point of −40° C. These samples were rated for platability and mechanical properties. The test items in Example 1 were supplemented with the r-value (Lankford value). The results are shown in Table 4. The samples according to the present invention had good platability, high strength and elongation, and good formability as indicated by the r-value no less than 1.1. By contrast, the sample No. 19 in Comparative Example was poor in platability although they underwent oxidation treatment under the conditions recommended in Japanese Patent Laid-open No. 34210/1995. A probable reason for this is an excess amount of Si and Mn. FIG. 7 shows the concentration distribution of Mn in the vicinity of the surface which was observed in sample No. 15 according to the present invention.

TABLE 4

| No. | Composition (wt %) C | Si | Mn | Oxidation treatment Temperature | Period of time | Alloying treatment Temperature | Period of time | Concentration of Mn in solid solution in interface % | Ratio to parent material | Concentration of Si in solid solution in interface % | Ratio to parent material | Platability | TS (MPa) | EI (%) | TS × EI | r-value |
|---|---|---|---|---|---|---|---|---|---|---|---|---|---|---|---|---|
| 15 | 0.002 | 0.14 | 1.4 | 700° C. | 20 s | 750° C. | 1 min | 0.78 | 0.56 | 0.11 | 0.78 | ○ | 454 | 35.5 | 16117 | 1.6 |
| 16 | 0.002 | 0.11 | 2.0 | 700° C. | 20 s | 750° C. | 1 min | 1.0 | 0.50 | 0.10 | 0.91 | ○ | 460 | 34.5 | 15870 | 1.6 |
| 17 | 0.002 | 0.40 | 1.4 | 700° C. | 20 s | 750° C. | 1 min | 0.85 | 0.60 | 0.26 | 0.65 | ○ | 485 | 34.0 | 16490 | 1.5 |
| 18 | 0.002 | 0.14 | 0.6 | 700° C. | 20 s | 750° C. | 1 min | 0.4 | 0.67 | 0.09 | 0.64 | ○ | 443 | 34.8 | 15416 | 1.4 |
| 19* | 0.002 | 0.11 | 2.0 | 600° C. | 5 s | 750° C. | 1 min | 1.5 | 0.75 | 0.10 | 0.91 | X | 475 | 36.5 | 17338 | 1.5 |

*Comparative Example
Sheet thickness: 1.2 mm

Example 3

Figure 8:
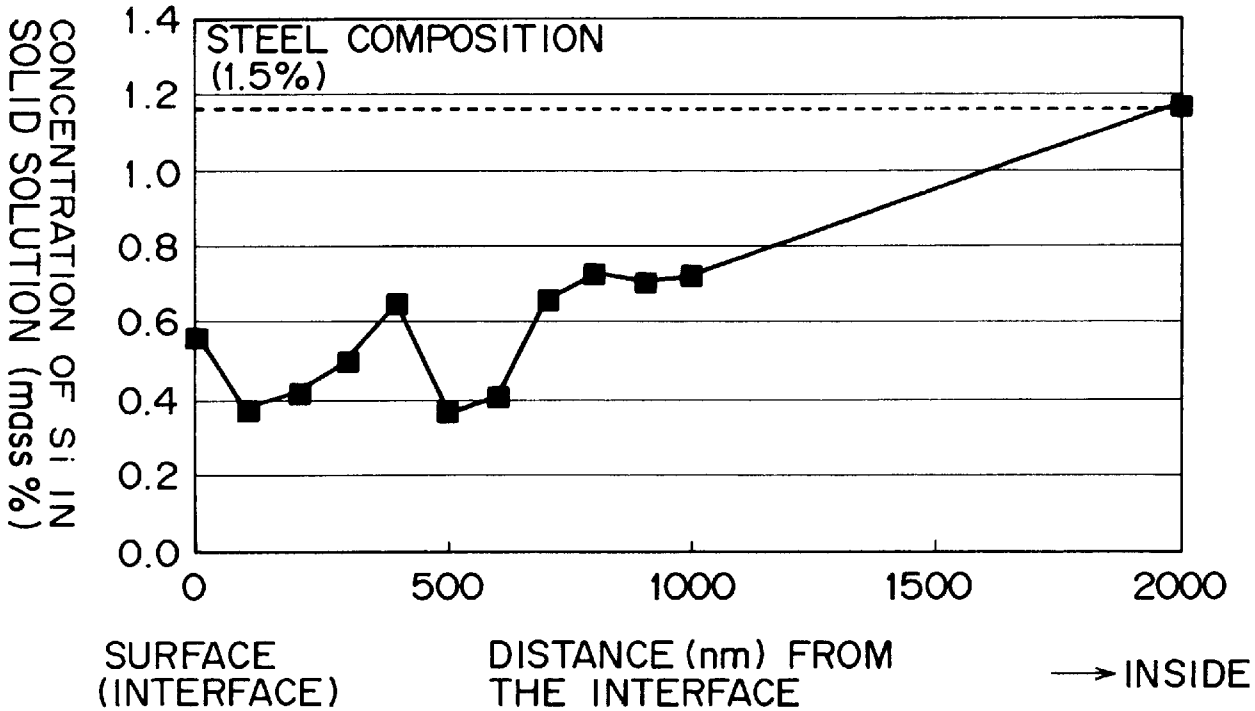
FIG. 8 is a diagram showing how the concentration of Si in the form of solid solution in the basis steel sheet is distributed in the vicinity of the interface between the basis steel sheet and the hot-dip galvanized zinc layer in Sample No. 20.

Samples of hot-dip galvanized steel sheets were prepared from several kinds of TRIP steel (transformation induced plasticity steel) incorporated with Mn and Si, by oxidation treatment in air under the conditions (for temperature and period of time) shown in Table 5 and ensuing reduction treatment at 800° C for 2 minutes in a hydrogen-nitrogen atmosphere containing 10% hydrogen and having a dew point of −40° C. These samples were rated for platability and mechanical properties. The test items in Example 1 were supplemented with the austenite fraction (Vγ) which was determined by X-ray diffraction. The results are shown in Table 5. The sample No. 20 according to the present invention had good platability, high strength and elongation, and a value of Vγ greater than 5%. By contrast, the sample No. 21 in Comparative Example was good in platability but poor in formability because of low values of TS×El. (Good platability is due to the low Si concentration which obviates the necessity of oxidation treatment.) The sample No. 22 in Comparative Example underwent oxidation treatment under the conditions recommended in Japanese Patent Laid-open- No. 34210/1995. This sample was free of bare spots detectable by visual inspection after galvanizing. However, it was found by peel test that the plated layer was poor in adhesion. (This peel test consists of sticking a piece of cellophane tape onto the plated layer, bending the steel sheet through 180° C, and strip the cellophane tape off the bent part.) FIG. 8 shows the concentration distribution of Si in the vicinity of the surface which was observed in sample No. 20 according to the present invention.

TABLE 5

| | Composition (wt %) | | | Oxidation treatment | | Alloying treatment | | Concentration of Mn in solid solution in interface | | Concentration of Si in solid solution in interface | | | | | | | |
|---|---|---|---|---|---|---|---|---|---|---|---|---|---|---|---|---|---|
| No. | C | Si | Mn | Temperature | Period of time | Temperature | Period of time | % | Ratio to parent material | % | Ratio to parent material | Platability | Peeling | TS (MPa) | EI (%) | TS × EI | $V_\gamma$ |
| 20 | 0.10 | 1.2 | 1.6 | 700° C. | 20 s | 550° C. | 1 min | 1.6 | 1.0 | 0.38 | 0.32 | ○ | No | 640 | 34.5 | 22080 | 9 |
| 21* | 0.10 | 0.02 | 1.6 | none | | 550° C. | 1 min | 1.5 | 0.94 | 0.02 | 1.0 | ○ | No | 415 | 34.1 | 14151 | 0 |
| 22* | 0.10 | 1.2 | 1.6 | 650° C. | 20 s | 550° C. | 1 min | 1.5 | 0.94 | 0.90 | 0.75 | ○ | yes | 635 | 34.7 | 22034 | 9 |

*Comparative Examples
Sheet thickness: 1.2 mm

EFFECT OF THE INVENTION

The present invention makes it possible, by adequately controlling the state of the Si—Mn enriched phase, to produce hot-dip galvanized steel sheets free of bare spots from basis steel sheets which are subject to bare spots when incorporated with Si and Mn in a comparatively large amount so as to impart high tensile strength and good formability.

What is claimed is:

1. A hot-dip galvanized steel sheet composed of a basis steel sheet containing Si in an amount of 0.05–2.5 mass % and Mn in an amount of 0.2–3 mass % and a hot-dip galvanized zinc layer formed on the surface thereof, wherein said hot-dip galvanized zinc layer is formed in such a way that there is an Si—Mn enriched phase which is found, by observation under a scanning electron microscope or a transmission electron microscope, in the vicinity of the interface in a region no shorter than 50 μm in the cross section perpendicular to the interface between the basis steel sheet and the hot-dip galvanized zinc layer, said Si—Mn enriched phase containing more than twice as much Si and/or Mn as the basis steel sheet and extending over a length no more than 80% of the length of the interface observed.

2. The hot-dip galvanized steel sheet as defined in claim 1, wherein the Si—Mn enriched phase containing no less than twice as much Si and/or Mn as the basis steel sheet is found, by observation under a transmission electron microscope, in the boundary between grains or the inside of grains of the basis steel sheet within 1 μm in the depthwise direction from the interface.

3. The hot-dip galvanized steel sheet as defined in claim 2, wherein the Si—Mn enriched phase existing in the boundary between grains or the inside of grains of the basis steel sheet has a size no smaller than 5 nm×5 nm.

4. The hot-dip galvanized steel sheet as defined in claim 2, wherein the Si—Mn enriched phase existing in the grain boundary of the basis steel heat has a length no less than 10% of the overall length of the grain boundary of the basis steel sheet in the field of vision of observation.

5. The hot-dip galvanized steel sheet as defined in claim 1, which contains a compound no smaller than 5 nm in outside diameter, which is composed of atoms having an atomic number smaller than the average atomic number of atoms constituting the steel, in the boundary between grains or the inside of grains of the basis steel sheet within a range of 1 μm in the depthwise direction from the interface, said compound being observed under a transmission electron microscope.

6. A hot-dip galvanized steel sheet composed of a basis steel sheet containing Si in an amount of 0.05–2.5 mass % and Mn in an amount of 0.2–3 mass % and a hot-dip galvanized zinc layer formed on the surface thereof, wherein the basis steel sheet in the vicinity of the interface between the basis steel sheet and the hot-dip galvanized zinc layer contains Si or Mn in the form of solid solution such that its amount is less than 0.7 times the amount of Si or Mn in the composition of the basis steel sheet.

* * * * *